US011333408B2

(12) United States Patent
Takayama et al.

(10) Patent No.: US 11,333,408 B2
(45) Date of Patent: May 17, 2022

(54) CRYOCOOLER AND CRYOGENIC SYSTEM

(71) Applicant: SUMITOMO HEAVY INDUSTRIES, LTD., Tokyo (JP)

(72) Inventors: Hirokazu Takayama, Nishitokyo (JP); Xiaogang Lin, Nishitokyo (JP); Mingyao Xu, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 99 days.

(21) Appl. No.: 16/744,201

(22) Filed: Jan. 16, 2020

(65) Prior Publication Data

US 2020/0224931 A1 Jul. 16, 2020

(30) Foreign Application Priority Data

Jan. 16, 2019 (JP) ..... JP2019-004923

(51) Int. Cl.
*F25B 9/14* (2006.01)

(52) U.S. Cl.
CPC ..... *F25B 9/145* (2013.01); *F25B 2309/1414* (2013.01)

(58) Field of Classification Search
CPC ..... F25B 9/145; F25B 2309/1414
See application file for complete search history.

(56) References Cited

U.S. PATENT DOCUMENTS 4,645,001 A * 2/1987 Hillerstrom ..... F28D 7/087 165/159
9,234,691 B2 * 1/2016 Black ..... F17C 3/085
2001/0017202 A1 * 8/2001 Mitsumoto ..... B01J 19/002 165/174
2009/0293505 A1 * 12/2009 Wang ..... F25B 9/14 62/51.1
2014/0202174 A1 * 7/2014 Wang ..... F25B 9/14 62/6

FOREIGN PATENT DOCUMENTS

JP 2005-024239 A 1/2005

* cited by examiner

*Primary Examiner* — Lionel Nouketcha
(74) *Attorney, Agent, or Firm* — HEA Law PLLC

(57) ABSTRACT

A cryocooler includes an attachment flange including a refrigerant gas introduction port through which refrigerant gas is introduced into a recondensing chamber from an ambient temperature environment, and attachable to the recondensing chamber, and a cooling stage that is disposed inside the recondensing chamber when the attachment flange is attached to the recondensing chamber. The refrigerant gas introduction port is perpendicularly or obliquely oriented with respect to an axial direction of the cryocooler so that a refrigerant gas flow exiting the refrigerant gas introduction port deviates from the cooling stage.

12 Claims, 7 Drawing Sheets

CRYOCOOLER AND CRYOGENIC SYSTEM

RELATED APPLICATIONS

The content of Japanese Patent Application No. 2019-004923, on the basis of which priority benefits are claimed in an accompanying application data sheet, is in its entirety incorporated herein by reference.

BACKGROUND

Technical Field

Certain embodiments of the present invention relate to a cryocooler and a cryogenic system.

Description of Related Art

A cryocooler such as a pulse tube cryocooler and a Gifford-McMahon (GM) cryocooler is used as a cooling source for a refrigerant gas recondensing device. For example, a condensed liquid refrigerant cools superconducting devices, sensors, or other objects to a cryogenic temperature, and vaporizes after the cooling. The vaporized refrigerant is condensed again by the cryocooler.

SUMMARY

According to an aspect of the present invention, there is provided a cryocooler including an attachment flange including a refrigerant gas introduction port through which refrigerant gas is introduced into a recondensing chamber from an ambient temperature environment, and attachable to the recondensing chamber, and a cooling stage that is disposed inside the recondensing chamber when the attachment flange is attached to the recondensing chamber. The refrigerant gas introduction port is perpendicularly or obliquely oriented with respect to an axial direction of the cryocooler so that a refrigerant gas flow exiting the refrigerant gas introduction port deviates from the cooling stage.

According to another aspect of the present invention, there is provided a cryogenic system including a recondensing chamber that accommodates a cooling stage of the cryocooler, and a refrigerant gas introduction port installed in the recondensing chamber, and introducing refrigerant gas into the recondensing chamber from an ambient temperature environment. The refrigerant gas introduction port is perpendicularly or obliquely oriented with respect to an axial direction of the cryocooler so that a refrigerant gas flow exiting the refrigerant gas introduction port deviates from the cooling stage.

According to an aspect of the present invention, the cryocooler includes an attachment flange having a refrigerant gas introduction port through which refrigerant gas is introduced into a recondensing chamber from an ambient temperature environment, and attachable to the recondensing chamber, a cooling stage that is disposed inside the recondensing chamber when the attachment flange is attached to the recondensing chamber, and cooled to a cryogenic temperature which enables the refrigerant gas to be condensed, and a regenerator tube that connects the attachment flange to the cooling stage. The refrigerant gas introduction port has a plurality of holes formed around the regenerator tube on the attachment flange.

DETAILED DESCRIPTION

Figure 1:
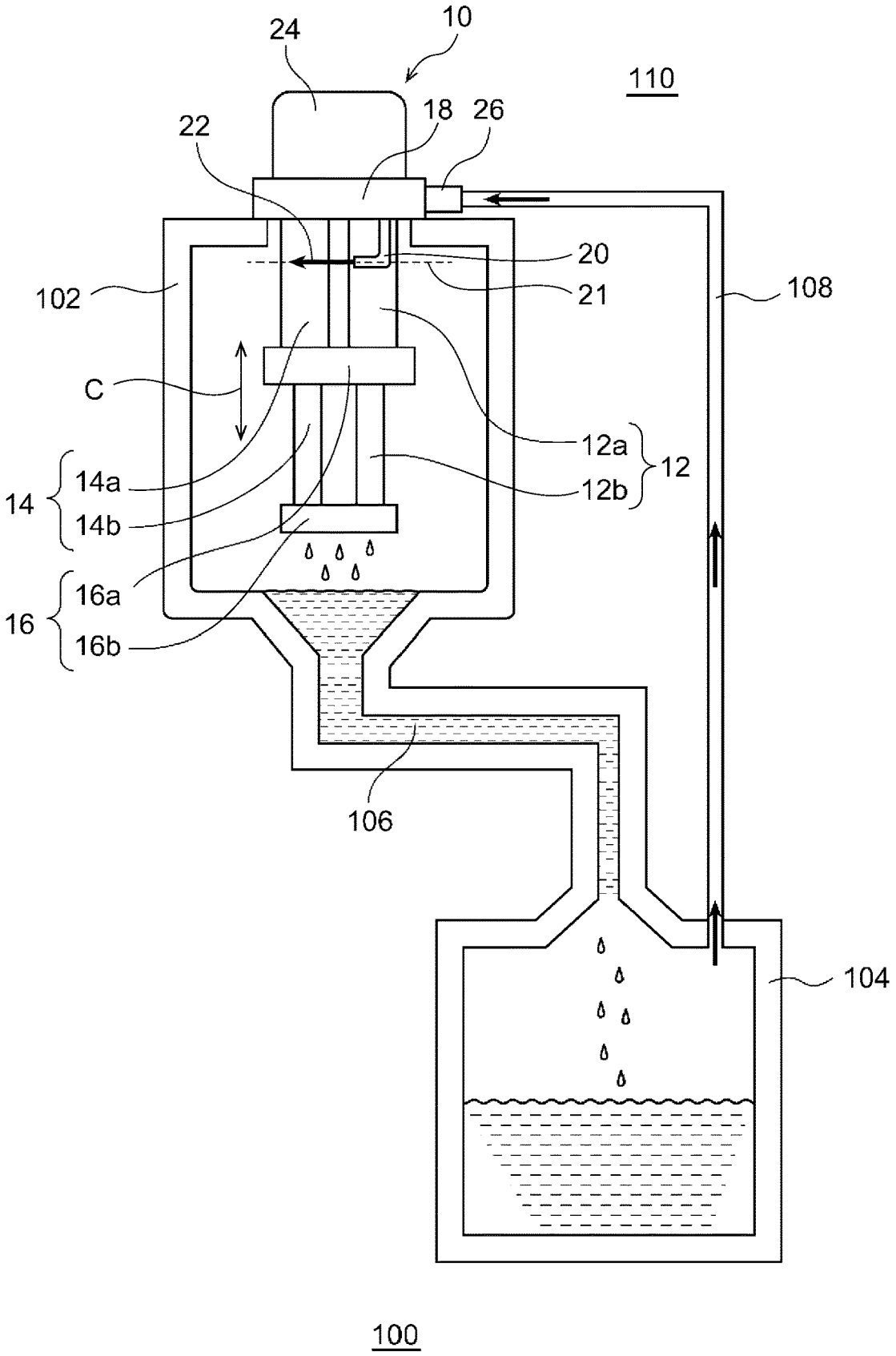
FIG. 1 is a schematic view illustrating a cryogenic system according to an embodiment.

The present inventors have studied a cryogenic system which uses a cryocooler to recondense a refrigerant, and have come to recognize problems as follows. As the cryogenic system, a system is known which adopts a circulation method as follows. A vaporized refrigerant once returns to an ambient temperature environment (e.g., a room temperature environment) from a low-temperature environment. Thereafter, the vaporized refrigerant is cooled and liquefied from an ambient temperature (e.g., a room temperature) to a liquefaction temperature in a recondensing chamber. A liquid refrigerant is used again in cooling an object at the low-temperature environment. In the related art, the cryocooler is installed in a top plate or an upper portion of the recondensing chamber so that a center axis of the cryocooler is aligned with a vertical direction, and a low-temperature section is disposed in the recondensing chamber. An inlet to the recondensing chamber of the refrigerant gas heated to the ambient temperature is formed close to the cryocooler. The ambient temperature gas blows out from the inlet toward a bottom portion of the recondensing chamber in a vertical direction. Therefore, the ambient temperature gas directly blows to the low-temperature section, or the ambient temperature gas easily reaches the vicinity of the low-temperature section. There is a quite great temperature difference between the ambient temperature gas and the low-temperature section. For example, the temperature difference is 100 K to 200 K. Accordingly, heat input from the ambient temperature gas to the low-temperature section may be a great heat load to the cryocooler. This may lead to a decrease in not only cooling capacity of the cryocooler but also condensing efficiency in refrigerant recondensing.

It is desirable to provide a cryocooler and a cryogenic system in which condensing efficiency is improved in refrigerant recondensing.

Any desired combination of the above-described components and those obtained by substituting the components or expressions according to the present invention with each other between methods, devices, and systems are also effective as an aspect of the present invention.

According to the present invention, it is possible to provide a cryocooler and a cryogenic system in which condensing efficiency is improved in refrigerant recondensing.

Hereinafter, embodiments for carrying out the present invention will be described in detail with reference to the drawings. In the description and the drawings, the same reference numerals will be assigned to the same or equivalent components, members, and processes, and repeated description will be omitted as appropriate. A scale or a shape of each element illustrated in the drawings is set for convenience in order to facilitate the description, and is not limitedly interpreted unless otherwise specified. The embodiments are merely examples, and do not limit the scope of the present invention. All features or combinations thereof described in the embodiments are not necessarily essential to the invention.

Figure 2:
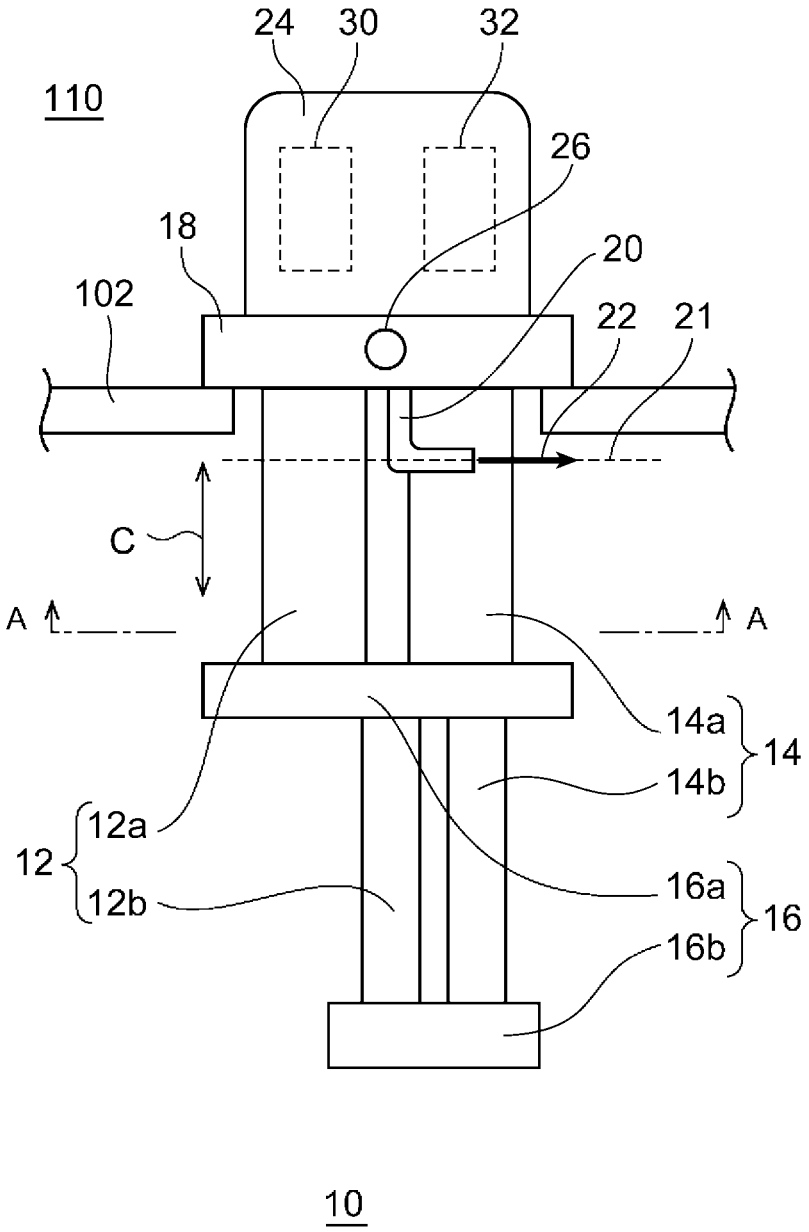
FIG. 2 is a schematic view illustrating a cryocooler according to the embodiment.
Figure 3:
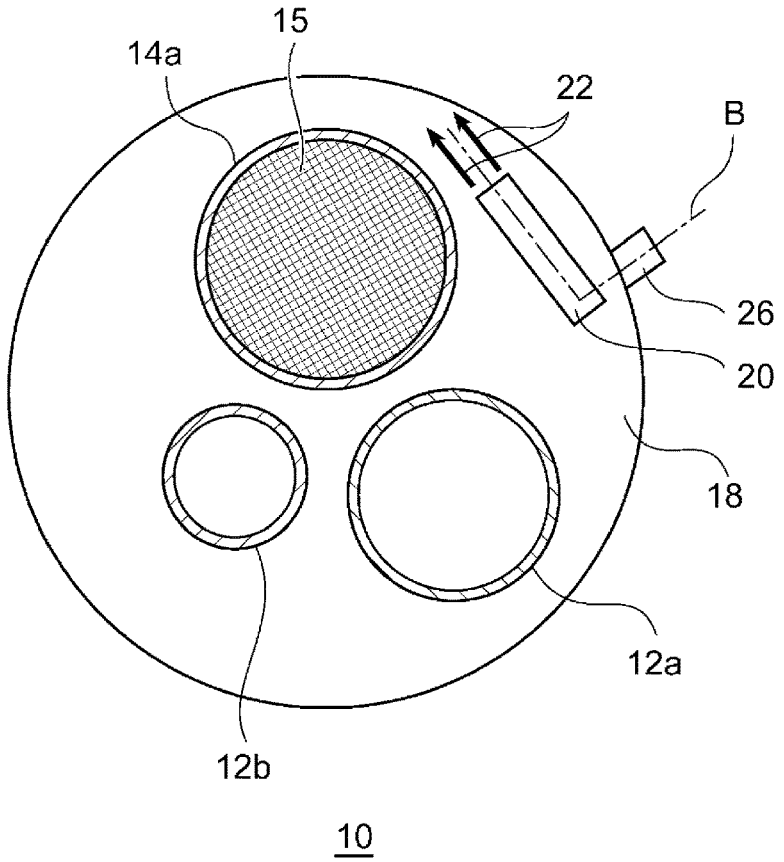
FIG. 3 is a schematic sectional view of the cryocooler illustrated in FIG. 2, which is taken along line A-A.
Figure 4:
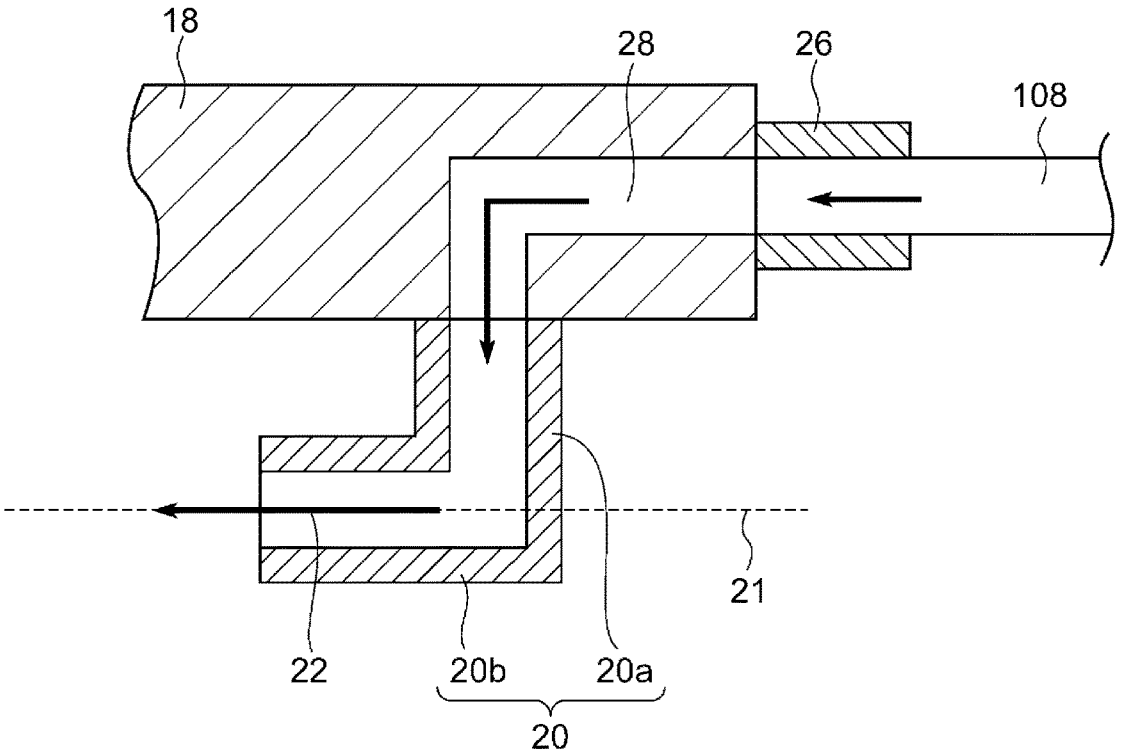
FIG. 4 is a schematic partial sectional view of the cryocooler illustrated in FIG. 3, which is taken along line B-B.

FIG. 1 is a schematic view illustrating a cryogenic system 100 according to an embodiment. FIG. 2 is a schematic view illustrating a cryocooler 10 according to the embodiment. FIG. 3 is a schematic sectional view of the cryocooler 10 illustrated in FIG. 2, which is taken along line A-A. FIG. 3 illustrates a positional relationship of components of the cryocooler 10 in a plane perpendicular to an axial direction C. FIG. 4 is a schematic partial sectional view of the cryocooler 10 illustrated in FIG. 3, which is taken along line B-B.

The cryogenic system 100 is configured to serve as a circulation system including a refrigerant recondenser, and includes the cryocooler 10 as a cooling source. According to the embodiment, a refrigerant is helium. Accordingly, helium gas is recondensed to liquid helium by the cryocooler 10. However, the cryogenic system 100 can also use other suitable refrigerants such as nitrogen, for example.

The cryogenic system 100 includes a recondensing chamber 102, a liquid refrigerant tank 104, a liquid transport pipe 106, and a liquid return pipe 108. A bottom portion of the recondensing chamber 102 and the liquid refrigerant tank 104 are connected to each other by the liquid transport pipe 106. An upper portion of the recondensing chamber 102 and the liquid refrigerant tank 104 are connected to each other by the liquid return pipe 108. The recondensing chamber 102, the liquid refrigerant tank 104, and the liquid transport pipe 106 configure a vacuum heat insulating container, and the vacuum heat insulating container internally has a low-temperature environment with a refrigerant atmosphere. The liquid return pipe 108 is disposed in an ambient temperature environment 110, which may be a room temperature environment. The liquid return pipe 108 may have a pump for circulating the refrigerant.

As an example, the cryocooler 10 is a two-stage pulse tube cryocooler of a Gifford-McMahon (GM) type. Accordingly, the cryocooler 10 includes a first stage pulse tube 12*a*, a second stage pulse tube 12*b*, a first stage regenerator tube 14*a*, a second stage regenerator tube 14*b*, a first stage cooling stage 16*a*, and a second stage cooling stage 16*b*. Hereinafter, for convenience of description, hereinafter, the first stage pulse tube 12*a* and the second stage pulse tube 12*b* may be collectively referred to as a pulse tube 12. Similarly, the first stage regenerator tube 14*a* and the second stage regenerator tube 14*b* may be collectively referred to as a regenerator tube 14, and the first stage cooling stage 16*a* and the second stage cooling stage 16*b* may be collectively referred to as a cooling stage 16.

The cryocooler 10 further includes an attachment flange 18 attachable to the recondensing chamber 102 or other vacuum chambers. The first stage pulse tube 12*a* connects the attachment flange 18 to the first stage cooling stage 16*a*, and the second stage pulse tube 12*b* connects the attachment flange 18 to the second stage cooling stage 16*b*. The first stage regenerator tube 14*a* connects the attachment flange 18 to the first stage cooling stage 16*a*. The second stage regenerator tube 14*b* connects the first stage cooling stage 16*a* to the second stage cooling stage 16*b*. The attachment flange 18 may be referred to as a top flange.

The cryocooler 10 is detachably installed on a top plate or an upper portion of the recondensing chamber 102 so that a center axis thereof coincides with a vertical direction, and the cooling stage 16 is disposed inside the recondensing chamber 102. Therefore, according to the embodiment, the axial direction C of the cryocooler 10 is the vertical direction. However, an attachment posture of the cryocooler 10 is not limited thereto. The cryocooler 10 can be installed in a desired posture, and may be installed in the recondensing chamber 102 so that the axial direction C coincides with an oblique direction or a horizontal direction.

In the cryogenic system 100, the refrigerant, that is, the helium circulates as follows. First, the helium gas is introduced into the recondensing chamber 102 from the ambient temperature environment 110 through a refrigerant gas introduction port 20. The helium gas is cooled by the first stage cooling stage 16*a* and the second stage cooling stage 16*b*, and is liquefied by the second stage cooling stage 16*b*. The liquefied helium drops from the second stage cooling stage 16*b* to the bottom portion of the recondensing chamber 102, and flows into the liquid refrigerant tank 104 through the liquid transport pipe 106. In this way, liquid helium is stored in the liquid refrigerant tank 104. The liquid helium is used in cooling an object. As a result, the vaporized helium exits an upper portion of the liquid refrigerant tank 104 to the ambient temperature environment 110 through the liquid return pipe 108. The helium gas is heated to an approximately room temperature by a peripheral heat inflow. The helium gas flows from the liquid return pipe 108 into the refrigerant gas introduction port 20, and is introduced again into the recondensing chamber 102.

As will be described in detail later, the attachment flange 18 has the refrigerant gas introduction port 20 through which the helium gas is introduced from the ambient temperature environment 110 to the recondensing chamber 102. The refrigerant gas introduction port 20 is oriented so that a refrigerant gas flow 22 exiting the refrigerant gas introduction port 20 is perpendicular to the axial direction C of the cryocooler 10. Accordingly, the refrigerant gas flow 22 deviates from both the first stage cooling stage 16*a* and the second stage cooling stage 16*b*. The refrigerant gas flow 22 does not directly collide with either the first stage cooling stage 16*a* or the second stage cooling stage 16*b*. In other words, a virtual straight line 21 passing through a center of the refrigerant gas introduction port 20 and extending along the refrigerant gas introduction port 20 is perpendicular to the axial direction C, and does not intersect the cooling stage 16.

The refrigerant gas introduction port 20 may be oriented at an oblique angle with respect to the axial direction C of the cryocooler 10 so that the refrigerant gas flow 22 exiting the refrigerant gas introduction port 20 deviates from the cooling stage 16. The straight line 21 may obliquely extend not to intersect the cooling stage 16. For example, the oblique angle may fall within 45 degrees with respect to a direction perpendicular to the axial direction C (for example, a horizontal direction).

Components of the cryocooler 10 will be described with reference to FIGS. 2 and 3.

The first stage pulse tube 12*a* and the second stage pulse tube 12*b* respectively extend in the axial direction C. The first stage regenerator tube 14*a* and the second stage regenerator tube 14*b* are connected to each other in series, and extend in the axial direction C. The first stage regenerator tube 14*a* is disposed in parallel with the first stage pulse tube 12*a*, and the second stage regenerator tube 14*b* is disposed in parallel with the second stage pulse tube 12*b*. The first stage pulse tube 12*a* has approximately the same length as the length of the first stage regenerator tube 14*a* in the axial direction C. The second stage pulse tube 12*b* has approximately the same length as a total length of the first stage regenerator tube 14*a* and the second stage regenerator tube 14*b* in the axial direction C.

In an exemplary configuration, the pulse tube 12 is a cylindrical tube which internally has a cavity. The regenerator tube 14 is a cylindrical tube internally filled with a regenerator material 15, and both of these are disposed adjacent to each other so that both center axes are parallel to each other.

A low-temperature end of the first stage pulse tube 12*a* and a low-temperature end of the first stage regenerator tube 14*a* are structurally connected to and thermally coupled with each other by the first stage cooling stage 16*a*. Similarly, a low-temperature end of the second stage pulse tube 12*b* and a low-temperature end of the second stage regenerator tube 14*b* are structurally connected to and thermally coupled with each other by the second stage cooling stage 16*b*. On the other hand, respective high-temperature ends of the first stage pulse tube 12*a*, the second stage pulse tube 12*b*, and the first stage regenerator tube 14*a* are connected to each other by the attachment flange 18.

The cooling stage 16 is formed of a metal material having high thermal conductivity such as copper, for example. On the other hand, the pulse tube 12 and the regenerator tube 14 are formed of a metal material having lower thermal conductivity than the cooling stage 16 such as stainless steel, for example.

The pulse tube 12 and the regenerator tube 14 extend from one main surface of the attachment flange 18, and the head portion 24 is disposed on the other main surface of the attachment flange 18. For example, the attachment flange 18 is a vacuum flange, and is attached to the recondensing chamber 102 so as to maintain airtightness of the recondensing chamber 102. When the attachment flange 18 is attached to the recondensing chamber 102, the pulse tube 12, the regenerator tube 14, and the cooling stage 16 are accommodated in the recondensing chamber 102, and the head portion 24 is disposed in the ambient temperature environment 110.

As will be understood from FIGS. 2 and 3, the refrigerant gas introduction port 20 is oriented perpendicular to the axial direction C so that the refrigerant gas flow 22 deviates not only from the cooling stage 16 but also from the pulse tube 12. The refrigerant gas flow 22 does not directly collide with either the first stage pulse tube 12*a* or the second stage pulse tube 12*b*. The straight line 21 does not intersect the pulse tube 12 as well as the cooling stage 16.

The refrigerant gas introduction port 20 may be oriented at an oblique angle with respect to the axial direction C so that the refrigerant gas flow 22 deviates from the cooling stage 16 and the pulse tube 12. The straight line 21 may obliquely extend not to intersect the cooling stage 16 and the pulse tube 12.

The refrigerant gas introduction port 20 is oriented so that the refrigerant gas flow 22 exchanges heat with the first stage regenerator tube 14*a*. For example, the refrigerant gas introduction port 20 is oriented as follows. The refrigerant gas flow 22 passes through the vicinity of the first stage regenerator tube 14*a*. In this manner, the refrigerant gas flow 22 exchanges heat with the first stage regenerator tube 14*a*. The refrigerant gas flow 22 flows adjacent to a surface of the first stage regenerator tube 14*a* or along the surface of the first stage regenerator tube 14*a*. The refrigerant gas introduction port 20 may be oriented so that the refrigerant gas flow 22 collides with the first stage regenerator tube 14*a*.

The refrigerant gas introduction port 20 is disposed in the vicinity of the first stage regenerator tube 14*a*. For example, the refrigerant gas introduction port 20 is disposed on the attachment flange 18 so as to be closer to the first stage regenerator tube 14*a* than the first stage pulse tube 12*a*. The refrigerant gas introduction port 20 is disposed on the attachment flange 18 so as to be closer to the first stage regenerator tube 14*a* than the second stage pulse tube 12*b*.

The refrigerant gas introduction port 20 is disposed in an outer peripheral portion of the attachment flange 18. The first stage regenerator tube 14*a*, the first stage pulse tube 12*a*, and the second stage pulse tube 12*b* are disposed closer to a central portion of the attachment flange 18 than the refrigerant gas introduction port 20.

The attachment flange 18 has a refrigerant gas receiving port 26 to which the liquid return pipe 108 is connected. The refrigerant gas receiving port 26 is installed on aside surface of the attachment flange 18. For example, the refrigerant gas receiving port 26 is a detachable joint such as a self-sealing coupling, and the liquid return pipe 108 can be easily attached to or detached from the refrigerant gas receiving port 26.

As illustrated in FIG. 4, the attachment flange 18 has a flange internal flow path 28 that connects the refrigerant gas introduction port 20 to the refrigerant gas receiving port 26. An ambient temperature refrigerant gas introduction line is configured to include the refrigerant gas introduction port 20, the refrigerant gas receiving port 26, and the flange internal flow path 28. The refrigerant gas flows from the liquid return pipe 108 to the refrigerant gas introduction port 20 through the refrigerant gas receiving port 26 and the flange internal flow path 28. For example, the refrigerant gas introduction port 20 is an elbow-shaped pipe attached to the attachment flange 18. Accordingly, the refrigerant gas introduction port 20 has a vertical pipe 20*a* that receives the refrigerant gas from the flange internal flow path 28, and a horizontal pipe 20*b* that introduces the refrigerant gas into the recondensing chamber 102. The straight line 21 extends along the horizontal pipe 20*b* by passing through the center of the horizontal pipe 20*b*.

As illustrated in FIG. 2, the head portion 24 has an oscillation flow generating source 30 and a phase control mechanism 32 of the cryocooler 10. As is well known, in a case where the cryocooler 10 is a pulse tube cryocooler of a GM type, as the oscillation flow generating source 30, a combination of a compressor that produces a steady flow of working gas and a flow path switching valve that is connected to the pulse tube 12 and the regenerator tube 14 by periodically switching between a high-pressure side and a low-pressure side of the compressor is used. The flow path switching valve functions as the phase control mechanism 32 together with a buffer tank disposed if necessary. In a case where the cryocooler 10 is a pulse tube cryocooler of a Stirling type, as the oscillation flow generating source 30, a compressor that generates an oscillation flow by using a harmonically oscillating piston. As the phase control mechanism 32, a buffer tank and a communication path connecting the buffer tank to the high-temperature end of the pulse tube 12 are used.

The oscillation flow generating source 30 may not be incorporated into the head portion 24 (that is, the oscillation flow generating source 30 may not be directly attached to the attachment flange 18). The oscillation flow generating source 30 may be disposed separately from the head portion 24, and may be connected to the head portion 24 by using a rigid or flexible pipe. Similarly, it is not essential that the phase control mechanism 32 is directly attached to the attachment flange 18. The phase control mechanism 32 may be disposed separately from the head portion 24, and may be connected to the head portion 24 by using the rigid or flexible pipe.

According to this configuration, the cryocooler 10 properly delays a displacement oscillation phase of a gas element (also referred to as a gas piston) inside the pulse tube 12 compared to pressure oscillation of the working gas. In this manner, PV work is generated in the low-temperature end of the pulse tube 12, and the cooling stage 16 can be cooled. In this way, the cryocooler 10 can cool gas or a liquid which comes into contact with the cooling stage 16, or an object thermally coupled to the cooling stage 16.

In a case where the cryocooler 10 is used for helium recondensing, for example, the first stage cooling stage 16*a* is cooled to be lower than 100 K (for example, approximately 30 K to 60 K). The second stage cooling stage 16*b* is cooled to be approximately 4 K which is a helium liquefaction temperature, or lower than 4 K. In a case where the cryocooler 10 is used in recondensing other refrigerants, at least the second stage cooling stage 16*b* is cooled to be equal to or lower than the liquefaction temperature of the refrigerants.

Figure 5:
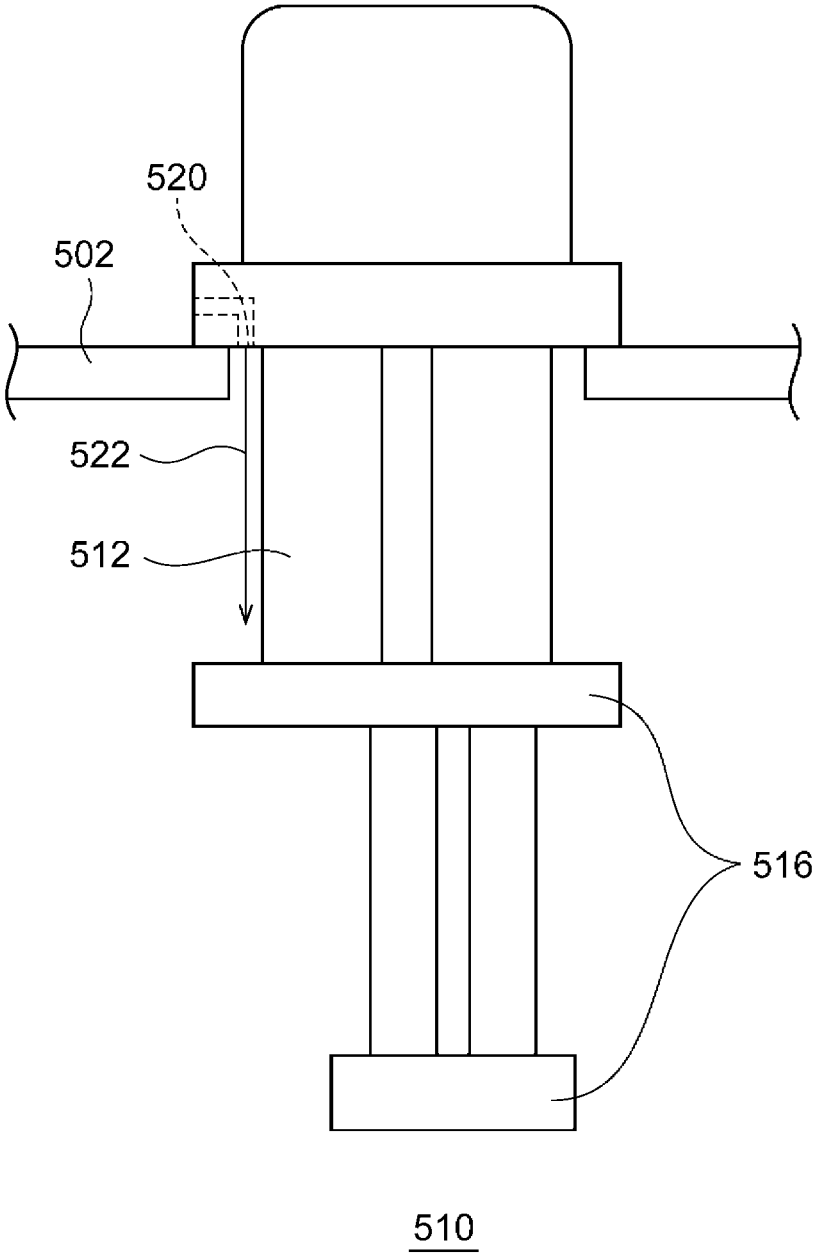
FIG. 5 is a schematic view illustrating a cryocooler according to a comparative example.

FIG. 5 is a schematic view illustrating a cryocooler 510 according to a comparative example. The cryocooler 510 is installed in a top plate or an upper portion of a recondensing chamber 502 so that a center axis thereof coincides with the vertical direction, and a low-temperature section 516 is disposed inside the recondensing chamber 502. An inlet 520 of the ambient temperature refrigerant gas flowing to the recondensing chamber 502 is also disposed close to the cryocooler 510. From the inlet 520, room temperature gas 522 blows out toward the bottom portion of the recondensing chamber 502 in the vertical direction.

Therefore, the ambient temperature gas 522 directly blows to the low-temperature section 516, or the ambient temperature gas 522 easily reaches the vicinity of the low-temperature section 516. There is a quite great temperature difference between the ambient temperature gas 522 and the low-temperature section 516. For example, the temperature difference is 100 K to 200 K. Accordingly, heat input from the ambient temperature gas 522 to the low-temperature section 516 may be a great heat load to the cryocooler 510.

The pulse tube 512 is a tube which internally has a cavity, and has relatively small heat capacity. Accordingly, if the pulse tube 512 receives the input heat, the temperature of the pulse tube 512 is likely to increase. The ambient temperature gas 522 flows along the surface of the pulse tube 512. Accordingly, the pulse tube 512 is easily heated.

Therefore, not only the cooling capacity of the cryocooler 510 but also the condensing efficiency in refrigerant recondensing decreases. In a worst case, the cryocooler 510 cannot condense the refrigerant.

However, according to the cryogenic system 100 and the cryocooler 10 in the above-described embodiment, the refrigerant gas introduction port 20 is perpendicularly or obliquely oriented with respect to the axial direction C of the cryocooler 10 so that the refrigerant gas flow 22 exiting the refrigerant gas introduction port 20 deviates from the cooling stage 16. Compared to the comparative example illustrated in FIG. 5, the refrigerant gas flow 22 has a smaller velocity component in the axial direction C. Accordingly, the refrigerant gas flow 22 is less likely to flow in the axial direction C. The refrigerant gas gradually descends to the first stage cooling stage 16*a* by a convection flow of the refrigerant inside the recondensing chamber 102, and further descends to the second stage cooling stage 16*b*. The refrigerant gas is gradually cooled while the refrigerant gas descends. Therefore, the heat input from the refrigerant gas to the cooling stage 16 is reduced. The cooling capacity of the cryocooler 10 is less affected by the refrigerant gas flow 22, and refrigerant condensing efficiency is improved.

In addition, the refrigerant gas introduction port 20 is perpendicularly or obliquely oriented with respect to the axial direction C of the cryocooler 10 so that the refrigerant gas flow 22 deviates from the pulse tube 12. The heat input from the refrigerant gas to the pulse tube 12 is reduced. The cooling capacity of the cryocooler 10 is less affected, and the refrigerant condensing efficiency is improved.

Furthermore, the refrigerant gas introduction port 20 is oriented so that the refrigerant gas flow 22 exchanges the heat with the first stage regenerator tube 14*a*. The regenerator tube 14 is filled with the regenerator material 15. Accordingly, the regenerator tube 14 has significantly higher heat capacity than the pulse tube 12. Therefore, even if the refrigerant gas flow 22 collides with the regenerator tube 14, the temperature does not easily increase as in the pulse tube 12. The regenerator tube 14 can rather cool the refrigerant gas flow 22.

Figure 6:
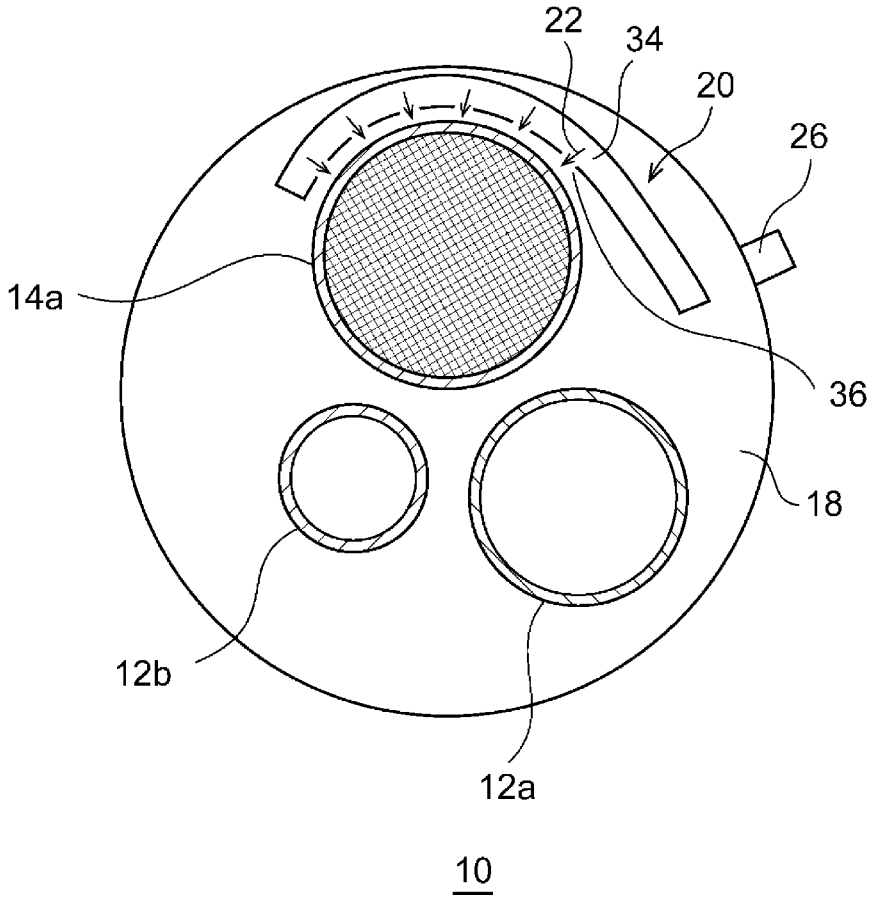
FIG. 6 is a schematic view illustrating another example of the cryocooler according to the embodiment.

FIG. 6 is a schematic view illustrating another example of the cryocooler 10 according to the embodiment. The refrigerant gas introduction port 20 has a refrigerant gas conduit 34 extending from the attachment flange 18 to the vicinity of the first stage regenerator tube 14*a*. The refrigerant gas conduit 34 has a plurality of holes 36 that direct the refrigerant gas to the first stage regenerator tube 14*a*. The plurality of holes 36 are oriented so that the refrigerant gas flow 22 collides with the first stage regenerator tube 14*a*.

The refrigerant gas conduit 34 extends while being curved along the surface of the first stage regenerator tube 14*a* with a gap from the surface of the first stage regenerator tube 14*a*. The plurality of holes 36 are disposed along the longitudinal direction of the refrigerant gas conduit 34 so as to face the surface of the first stage regenerator tube 14*a*.

According to this configuration, the refrigerant gas flow 22 can directly collide with the first stage regenerator tube 14*a*, and the refrigerant gas flow 22 can be efficiently cooled by the first stage regenerator tube 14*a*. The refrigerant gas conduit 34 has the plurality of holes 36. Accordingly, the refrigerant gas is dispersed. It is possible to suppress local temperature fluctuations in the first stage regenerator tube 14*a* which may be caused by the refrigerant gas flow 22. The cooling capacity of the cryocooler 10 is less affected by the refrigerant gas flow 22, and the refrigerant condensing efficiency is improved.

Figure 7:
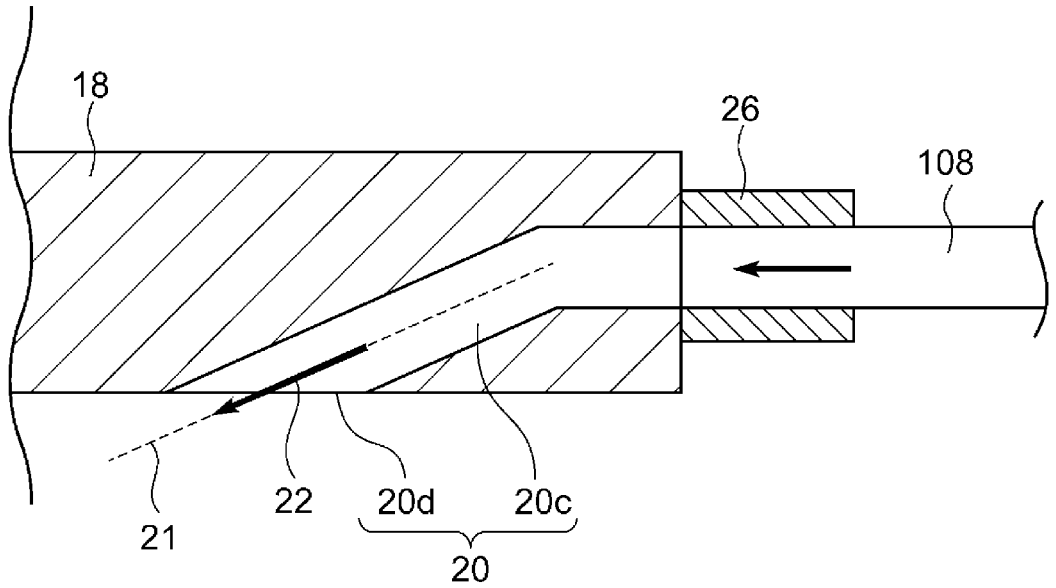
FIG. 7 is a schematic view illustrating another example of the cryocooler according to the embodiment.

FIG. 7 is a schematic view illustrating another example of the cryocooler 10 according to the embodiment. It is not essential that the refrigerant gas introduction port 20 has the elbow-shaped pipe. The refrigerant gas introduction port 20 may have an oblique flow path 20*c* formed inside the attachment flange 18, and a hole 20*d* formed on the attachment flange 18. The refrigerant gas flows from the liquid return pipe 108 to the refrigerant gas introduction port 20 through the refrigerant gas receiving port 26. The refrigerant gas is introduced into the recondensing chamber 102 from the refrigerant gas introduction port 20. The refrigerant gas introduction port 20 may be oriented at an oblique angle with respect to the axial direction C of the cryocooler 10 so that the refrigerant gas flow 22 exiting the refrigerant gas introduction port 20 deviates from the cooling stage 16. The straight line 21 may obliquely extend not to intersect the cooling stage 16. Even in this case, the cooling capacity of the cryocooler 10 is less affected, and the refrigerant condensing efficiency is improved.

Figure 8:
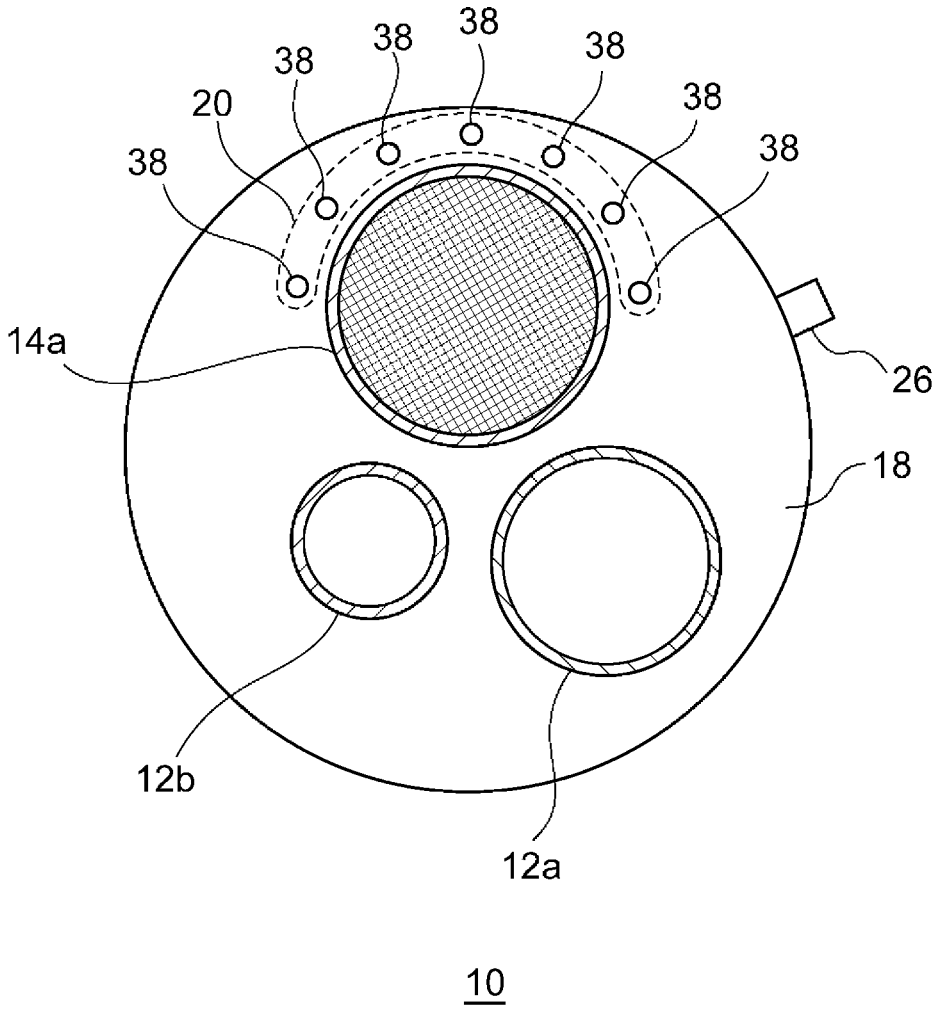
FIG. 8 is a schematic view illustrating another example of the cryocooler according to the embodiment.

FIG. 8 is a schematic view illustrating another example of the cryocooler 10 according to the embodiment. The refrigerant gas introduction port 20 has a plurality of holes 38 formed around the first stage regenerator tube 14*a* on the attachment flange 18. The hole 38 is connected to the refrigerant gas receiving port 26 through a flow path inside the attachment flange 18. The hole 38 is oriented so that the refrigerant gas is directed in the axial direction. The refrigerant gas exiting the hole 38 flows in the axial direction along the surface of the first stage regenerator tube 14*a*. Accordingly, the refrigerant gas is cooled by the first stage regenerator tube 14*a*. The refrigerant gas introduction port 20 has the plurality of holes 38. Accordingly, the refrigerant gas is dispersed. Even in this case, the cooling capacity of the cryocooler 10 is less affected, and the refrigerant condensing efficiency is improved. The hole 38 may be oriented at an oblique angle with respect to the axial direction.

Hitherto, the configuration has been described in which the attachment flange 18 of the cryocooler 10 has the refrigerant gas introduction port 20. However, the present invention is not limited to this configuration. Instead of the attachment flange 18, the recondensing chamber 102 may have the refrigerant gas introduction port 20. An embodiment configured in this way will be described.

Figure 9:
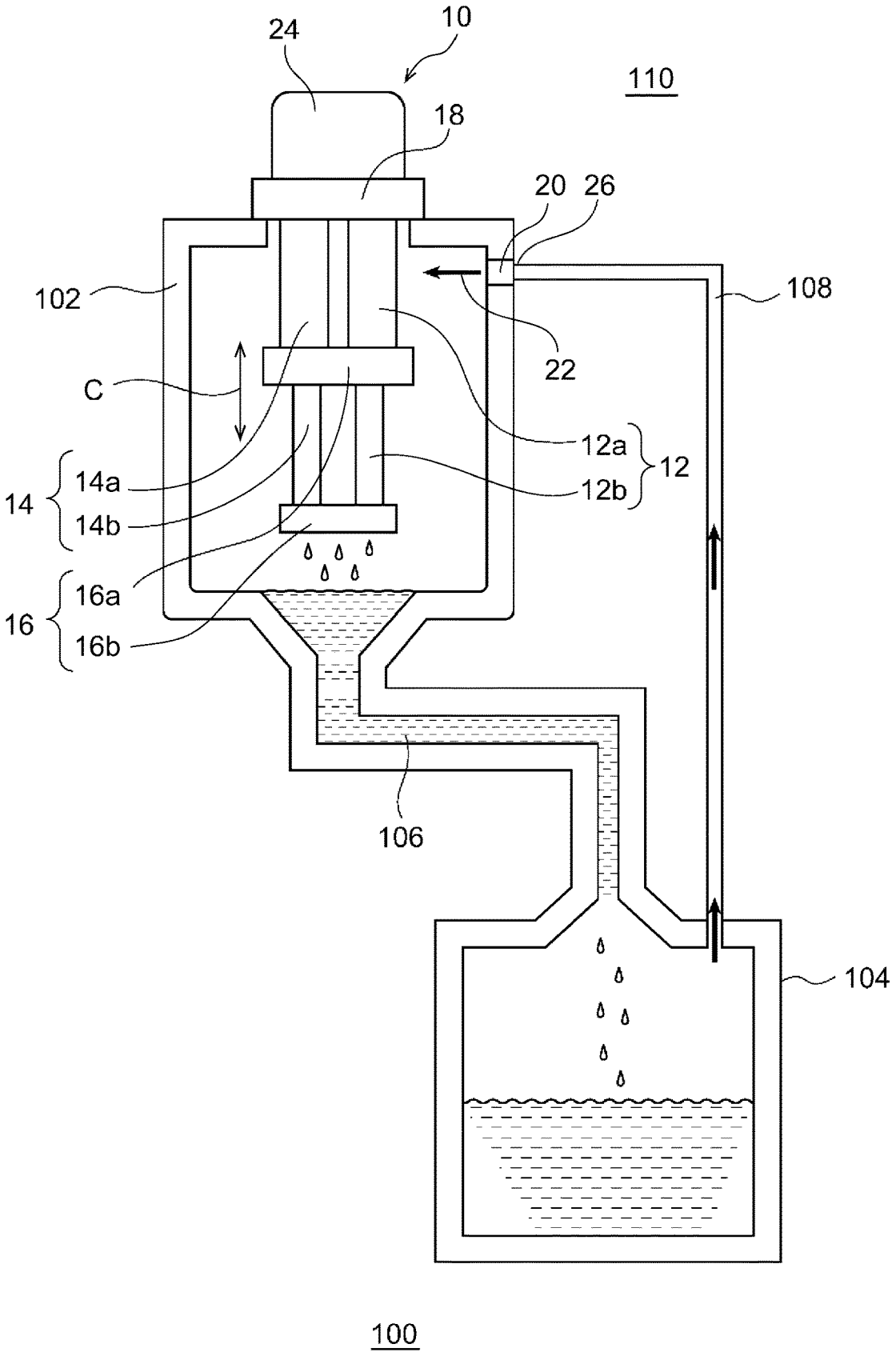
FIG. 9 is a schematic view illustrating a cryogenic system according to another embodiment.

FIG. 9 is a schematic view illustrating the cryogenic system 100 according to another embodiment. The cryogenic system 100 according to another embodiment is different from the cryogenic system 100 according to the above-described embodiment with regard to the disposition of the refrigerant gas introduction port 20, and other configurations are generally common to each other. Hereinafter, different configurations will be mainly described, and common configurations will be briefly described or will not be described.

The cryogenic system 100 includes the recondensing chamber 102 that accommodates the cooling stage 16 of the cryocooler 10, and the refrigerant gas introduction port 20 installed in the recondensing chamber 102 so as to introduce the refrigerant gas from the ambient temperature environment 110 into the recondensing chamber 102. The refrigerant gas introduction port 20 is perpendicularly (or obliquely) oriented with respect to the axial direction C of the cryocooler 10 so that the refrigerant gas flow 22 exiting the refrigerant gas introduction port 20 deviates from the cooling stage 16. Even in a case of another embodiment, as in the above-described embodiment, the cooling capacity of the cryocooler 10 is less affected by the refrigerant gas flow 22, and the refrigerant condensing efficiency is improved.

The refrigerant gas introduction port 20 and the refrigerant gas receiving port 26 are disposed in the recondensing chamber 102. Accordingly, it is not necessary to form these room temperature refrigerant gas introduction lines in the attachment flange 18 of the cryocooler 10. Accordingly, the existing cryocooler 10 having a general-purpose vacuum flange can be used as the attachment flange 18.

Hitherto, the present invention has been described with reference to the embodiments. The present invention is not limited to the above-described embodiments, and design can be changed in various ways. It is understood by those skilled in the art that modification examples can be made in various ways and the modification examples also fall within the scope of the present invention. Various features described with regard to a certain embodiment are applicable to other embodiments. A newly combined embodiment has an advantageous effect achieved by each of the combined embodiments.

For example, the features described with regard to one embodiment are equally applicable to another embodiment.

The cryocooler 10 is not limited to the pulse tube cryocooler, and may be the GM cryocooler or other cryocoolers. For example, in a case of the GM cryocooler, the "regenerator tube" in the above-described embodiment may be a cylinder that accommodates a displacer having a regenerator incorporated therein. The GM cryocooler does not have the pulse tube.

In a case where the cryogenic system 100 employs the refrigerant other than the helium, the cryocooler 10 may be a single-stage cryocooler as long as the cryocooler 10 can be provided with the liquefaction temperature of the refrigerant.

The present invention has been described using specific terms with reference to the embodiments. However, the embodiments merely show one aspect of the principle and application of the present invention. Many modification examples or disposition changes are permitted within the scope not departing from the gist of the appended claims.

It should be understood that the invention is not limited to the above-described embodiment, but may be modified into various forms on the basis of the spirit of the invention. Additionally, the modifications are included in the scope of the invention.

What is claimed is:

1. A cryocooler comprising:

an attachment flange including a refrigerant gas introduction port through which refrigerant gas is introduced into a recondensing chamber from an ambient temperature environment, and attachable to the recondensing chamber; and a cooling stage that is disposed inside the recondensing chamber when the attachment flange is attached to the recondensing chamber, wherein the refrigerant gas introduction port is perpendicularly or obliquely oriented with respect to an axial direction of the cryocooler and a center line of the refrigerant gas introduction port extends not to intersect the cooling stage such that a refrigerant gas flow exiting the refrigerant gas introduction port deviates from the cooling stage.

2. The cryocooler according to claim 1, further comprising:

a pulse tube that connects the attachment flange to the cooling stage, wherein the refrigerant gas introduction port is perpendicularly or obliquely oriented with respect to the axial direction of the cryocooler and the center line of the refrigerant gas introduction port extends not to intersect the pulse tube such that the refrigerant gas flow exiting the refrigerant gas introduction port deviates from the cooling stage and the pulse tube.

3. The cryocooler according to claim 2, wherein the pulse tube is a cylindrical tube which internally has a cavity.

4. The cryocooler according to claim 1, further comprising:

a regenerator tube that connects the attachment flange to the cooling stage, wherein the refrigerant gas introduction port is oriented so that the refrigerant gas flow exiting the refrigerant gas introduction port exchanges heat with the regenerator tube.

5. The cryocooler according to claim 4, wherein the refrigerant gas introduction port includes a refrigerant gas conduit extending from the attachment flange to a vicinity and outside of the regenerator tube, and the refrigerant gas conduit includes a plurality of holes for directing the refrigerant gas toward an outer circumferential surface of the regenerator tube.

6. The cryocooler according to claim 5, wherein the plurality of holes are disposed along a longitudinal direction of the refrigerant gas conduit so as to face the outer circumferential surface of the regenerator tube.

7. The cryocooler according to claim 4, wherein the regenerator tube is a cylindrical tube which is internally filled with a regenerator material.

8. The cryocooler according to claim 1, wherein the refrigerant gas introduction port is an elbow-shaped pipe attached to the attachment flange.

9. The cryocooler according to claim 8, wherein the elbow-shaped pipe includes a vertical pipe portion that receives the refrigerant gas from a flange internal flow path and a horizontal pipe portion that introduces the refrigerant gas into the recondensing chamber.

10. The cryocooler according to claim 1, wherein the refrigerant gas introduction port is obliquely oriented with respect to the axial direction of the cryocooler, and an oblique angle falls within 45 degrees with respect to a direction perpendicular to the axial direction.

11. A cryocooler comprising:

an attachment flange including a refrigerant gas introduction port through which refrigerant gas is introduced into a recondensing chamber from an ambient temperature environment, and attachable to the recondensing chamber;

a cooling stage that is disposed inside the recondensing chamber when the attachment flange is attached to the recondensing chamber, and cooled to a cryogenic temperature which enables the refrigerant gas to be condensed; and a regenerator tube that connects the attachment flange to the cooling stage, wherein the refrigerant gas introduction port includes a plurality of holes formed on the attachment flange and around the regenerator tube, the plurality of holes arranged radially outward of an outer circumferential surface of the regenerator tube.

12. A cryogenic system comprising:

a recondensing chamber that accommodates a cooling stage of a cryocooler; and a refrigerant gas introduction port installed in the recondensing chamber, and introducing refrigerant gas into the recondensing chamber from an ambient temperature environment, wherein the refrigerant gas introduction port is perpendicularly or obliquely oriented with respect to an axial direction of the cryocooler and a center line of the refrigerant gas introduction port extends not to intersect the cooling stage such that a refrigerant gas flow exiting the refrigerant gas introduction port deviates from the cooling stage.

* * * * *